US012797681B2

(12) United States Patent
Wang et al.

(10) Patent No.: US 12,797,681 B2
(45) Date of Patent: Nov. 17, 2026

(54) EXERCISE DEVICES

(71) Applicant: SHENZHEN THOUSANDSHORES TECHNOLOGY CO., LTD., Shenzhen (CN)

(72) Inventors: Lei Wang, Shenzhen (CN); Junfei Deng, Shenzhen (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 19/185,229

(22) Filed: Apr. 21, 2025

(65) Prior Publication Data

US 2026/0034400 A1 Feb. 5, 2026

(30) Foreign Application Priority Data

Aug. 5, 2024 (CN) ..... 202421869789.X

(51) Int. Cl.
*A63B 23/12* (2006.01)
*A63B 1/00* (2006.01)
(Continued)

(52) U.S. Cl.
CPC ..... *A63B 23/1218* (2013.01); *A63B 1/00* (2013.01); *A63B 21/1636* (2013.01);
(Continued)

(58) Field of Classification Search
CPC ... A63B 23/1218; A63B 1/00; A63B 21/1636; A63B 21/4035; A63B 23/03525; A63B 24/0062; A63B 2220/05; A63B 2220/805; A63B 2220/833; A63B 21/1627; A63B 2220/806
See application file for complete search history.

(56) References Cited

U.S. PATENT DOCUMENTS 7,819,784 B1 * 10/2010 Caswell ..... A63B 21/4015 482/904
9,017,238 B2 4/2015 Meredith et al.
(Continued)

OTHER PUBLICATIONS

"2025 Upgrade Multi-Grip Pull Up Bar with Smart Larger Hooks Technology—USA Original Patent, Designed, Shipped, Warranty", Web page <https://www.amazon.com/KAKICLAY-Upgrade-Worlds-Strongest-Pullup/dp/B09BCLRHYL/>, Jul. 28, 2021.

*Primary Examiner* — Andrew S Lo
(74) *Attorney, Agent, or Firm* — PORUS IP LLC

(57) ABSTRACT

An exercise device including a fixing rod, a fixing hook, a connecting member, a first gripping member, and a second gripping member. The fixing rod and the second gripping member are disposed at two ends of the connecting member respectively. The first gripping member is mounted on the connecting member, and the first gripping member is selectively switchable between an extended position and a offset position. When the user grips the first gripping member, the first gripping member is at the extended position for the user to grip. When the user grips the second gripping member, the first gripping member is in the offset position to avoid the first gripping member interfering with an exercise process of the user, providing the user with a better use experience and safety.

19 Claims, 13 Drawing Sheets

(51) Int. Cl.

| | |
|---|---|
| ***A63B 21/00*** | (2006.01) |
| ***A63B 21/16*** | (2006.01) |
| ***A63B 23/035*** | (2006.01) |
| ***A63B 24/00*** | (2006.01) |

(52) U.S. Cl.
CPC .... *A63B 21/4035* (2015.10); *A63B 23/03525* (2013.01); *A63B 24/0062* (2013.01); *A63B 2220/05* (2013.01); *A63B 2220/805* (2013.01); *A63B 2220/833* (2013.01)

(56) References Cited

U.S. PATENT DOCUMENTS

| | | | | |
|---|---|---|---|---|
| 9,868,006 | B1 * | 1/2018 | Epler | A63B 21/068 |
| 10,898,752 | B1 * | 1/2021 | Kehoe | A63B 23/03525 |
| 11,484,746 | B2 * | 11/2022 | Kehoe | A63B 23/03525 |
| 2010/0234193 | A1 * | 9/2010 | Friedman | A63B 1/00 482/133 |
| 2014/0302968 | A1 * | 10/2014 | Velikin | A63B 1/00 482/40 |
| 2014/0323275 | A1 * | 10/2014 | Moses, II | A63B 21/1627 482/40 |
| 2021/0339075 | A1 * | 11/2021 | Listro | A63B 21/1636 |
| 2022/0032113 | A1 * | 2/2022 | Kehoe | A63B 21/1627 |
| 2024/0009514 | A1 * | 1/2024 | Perrin | A63B 1/005 |

* cited by examiner

EXERCISE DEVICES

CROSS-REFERENCE TO RELATED APPLICATION

This application claims priority of Chinese Patent Application No. 202421869789. X, filed on Aug. 5, 2024, the content of which is entirely incorporated herein by reference.

TECHNICAL FIELD

The present disclosure relates to the field of sports devices, and in particular to an exercise device.

BACKGROUND

In daily physical exercise scenarios, a door frame pull-up bar (or a door-mounted horizontal bar) has a large user market. However, when using existing door frame pull-up bars, users encounter interference with the equipment during use, which not only affects the effectiveness of the workout but also poses potential safety risks.

Thus, it is desirable to provide an exercise device that provides the user with a better use experience and improved safety.

SUMMARY

Embodiments of the present disclosure provide an exercise device including a fixing rod, a fixing hook, a connecting member, a first gripping member, and a second gripping member. The fixing rod cooperates with the fixing hook to fix the exercise device. The fixing rod and the second gripping member are respectively provided at both ends of the connecting member and the first gripping member is installed on the connecting member. The first gripping member is selectively switchable between an extended position and an offset position. When the first gripping member is at the extended position, the first gripping member and the fixing hook are respectively located on both sides of a reference plane formed by an axis of the connecting member and an axis of the fixing rod; when the first gripping member is at the offset position, an axis of the first gripping member is located in the reference plane, or the first gripping member and the fixing hook are located on the same side of the reference plane.

BRIEF DESCRIPTION OF THE DRAWINGS

The present disclosure will be further illustrated by exemplary embodiments, which will be described in detail by means of the accompanying drawings. These embodiments are not limiting, and in these embodiments, the same numbering denotes the same structure, wherein.

DETAILED DESCRIPTION

Figure 1:
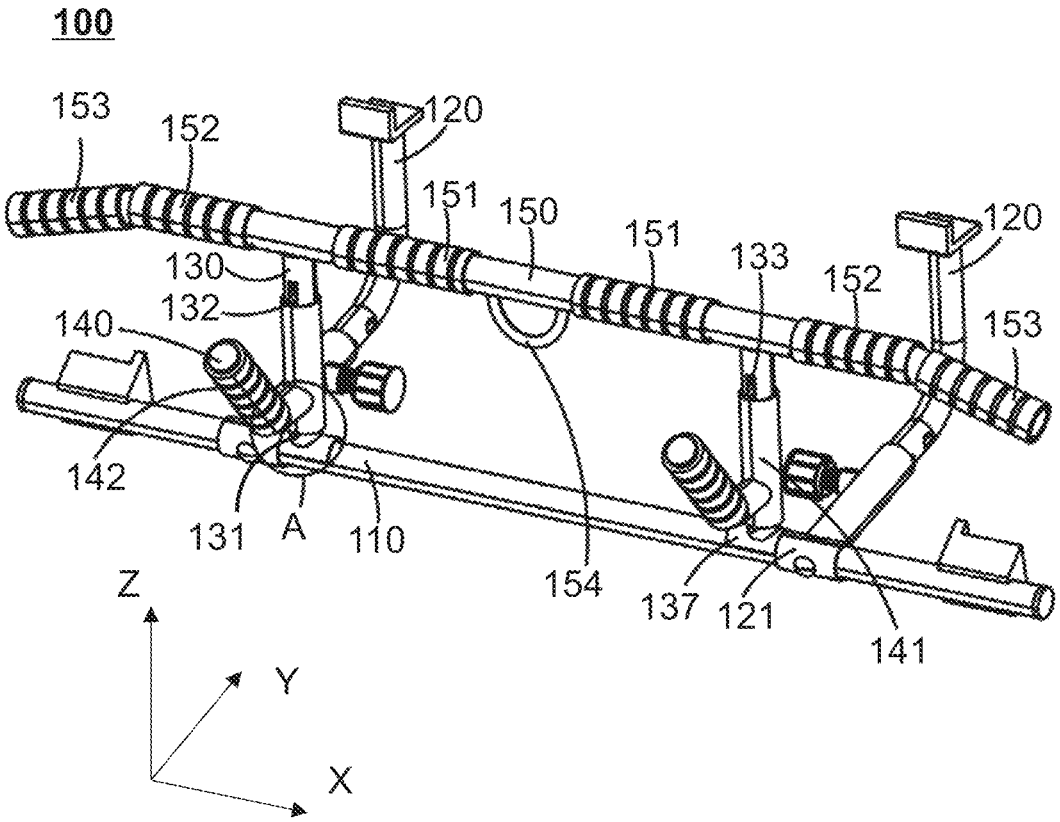
FIG. 1 is a schematic diagram illustrating an exercise device according to some embodiments of the present disclosure.
Figure 2:
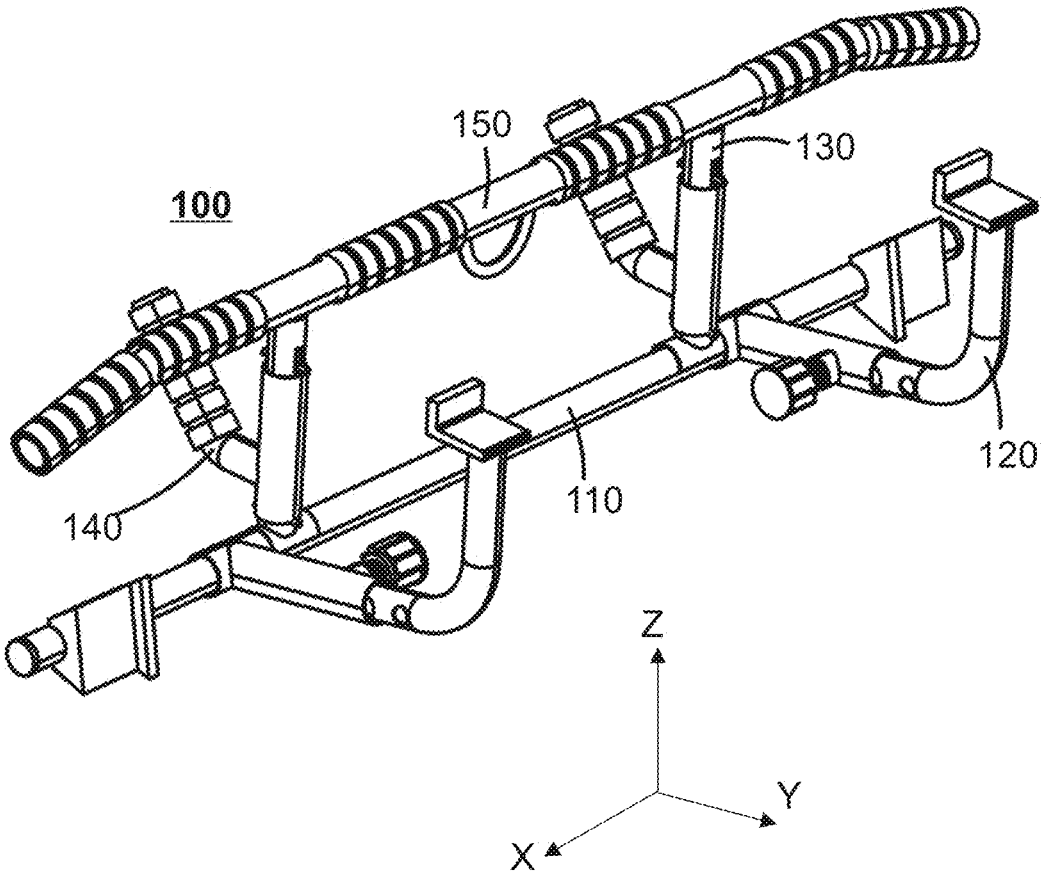
FIG. 2 is a schematic diagram illustrating an exercise device according to some embodiments of the present disclosure.

To more clearly illustrate the technical solutions of the embodiments of the present disclosure, the accompanying drawings required to be used in the description of the embodiments are briefly described below. Obviously, the accompanying drawings in the following description are only some examples or embodiments of the present disclosure, and it is possible for those skilled in the art to apply the present disclosure to other similar scenarios in accordance with these drawings without creative labor. Unless obviously obtained from the context or the context illustrates otherwise, the same numeral in the drawings refers to the same structure or operation.

It should be understood that the terms "system," "device," "unit" and/or "module" as used herein are used to distinguish between different components, elements, parts, sections, or assemblies at different levels. However, the words may be replaced by other expressions if other words accomplish the same purpose.

As shown in the present disclosure and in the claims, unless the context clearly suggests an exception, the words "a," "one," "an" and/or "the" do not refer specifically to the singular but may also include the plural. Generally, the terms "including" and "comprising" suggest only the inclusion of clearly identified steps and elements that do not constitute an exclusive list, and the method or device may also include other steps or elements.

A door frame pull-up bar (or a door-mounted horizontal bar) is a fitness device typically installed on a door frame used to perform movements such as pull-ups and pull-downs to build strength and endurance in the back, biceps, triceps, and other parts of a body. The door frame pull-up bar generally includes a first gripping member (e.g., a handle) facing a user and a second gripping member (e.g., a gripping rod) that is laterally disposed, so that the user is able to perform the exercise in different ways through the first gripping member (e.g., the handle) and the second gripping member (e.g., the gripping rod). However, when the user holds the second gripping member (e.g., the gripping rod) for exercising, as the first gripping member (e.g., the handle)

is positioned facing the user, the first gripping member (e.g., the handle) may interfere with the user's exercising process, which causes inconvenience and poses certain safety risks to the user.

Some embodiments of the present disclosure provide an exercise device. The first gripping member of the exercise device is designed to have an extended position toward the user and an offset position avoiding the user. In this way, the user is able to adjust the position of the first gripping member, which provides the user with a better use experience and improved safety.

FIGS. 1-5 are schematic diagrams illustrating an exercise device 100 according to some embodiments of the present disclosure.

The exercise device 100 is installed on a door frame and is mainly used for a user to perform movements of pull-ups, pull-downs, hangings, knee-bend leg raises, etc., so as to enable the user to exercise the back, biceps, humerus triceps, and other parts of a body for strength and endurance. In some embodiments, the exercise device 100 includes a door frame pull-up bar (or a door-mounted horizontal bar).

Referring to FIGS. 1-4, the exercise device 100 includes a fixing rod 110, a fixing hook 120, a connecting member 130, a first gripping member 140, and a second gripping member 150. The fixing rod 110 cooperates with the fixing hook 120 to fix the exercise device 100. The connecting member 130 is fixed to the fixing rod 110. The fixing rod 110 and the second gripping member 150 are disposed at the two ends of the connecting member 130. The first gripping member 140 is mounted on the connecting member 130.

In some embodiments, the exercise device 100 is installed or placed on a horizontal support surface (e.g., a ground, etc.). When using the exercise device 100, the fixing hook 120 is removed or rotated to a position where it does not interfere with or hinder the horizontal support surface, and the fixing rod 110 and the second gripping member 150 fits to the horizontal support surface. The user holds the exercise device 100 and performs exercises (e.g., push-ups, etc.) in a posture that is inclined to or nearly parallel to the horizontal support surface. In some embodiments, the fixing rod 110 and the fixing hook 120 are fixed directly to the horizontal support surface (e.g., by screw fixing, adhesive fixing, etc.) to enable an installation of the exercise device 100.

In some embodiments, the exercise device 100 is mounted on a door frame, and the user holds the exercise device 100 and performs exercises (e.g., the pull-ups, the pull-downs, etc.) in a posture that is parallel to, or nearly parallel to, a plane where the door frame is located. In some embodiments, the fixing rod 110 is fixed to one side of the door frame (e.g., an inner side of the door frame), and the fixing hook 120 abuts against the other side of the door frame (e.g. an outer side of the door frame), thereby enabling the installation of the exercise device 100. Exemplarily, two ends of the fixing rod 110 are fixed to two sides of the inner side of the door frame respectively through soft or elastic support sheets, and the fixing hooks 120 abuts against a top side of the outer side of the door frame, thereby realizing the installation of the exercise device 100. At this time, the user is located on the inner side of the door frame and holds the exercise device 100 for exercise.

The first gripping member 140 and the second gripping member 150 are used for the user to grip for exercising, and the first gripping member 140 and the second gripping member 150 are set up to provide the user with greater gripping portions so as to help the user to adopt different postures for exercise. In some embodiments, the first gripping member 140 is selectively switchable between an extended position and an offset position. When the first gripping member 140 is at the extended position, the first gripping member 140 and the fixing hook 120 are located on opposite sides of a reference plane (e.g., an XZ plane mentioned later) formed by an axis of the connecting member 130 and an axis of the fixing rod 110, and the first gripping member 140 faces toward the user; when the first gripping member 140 is at the offset position, an axis of the first gripping member 140 is located within the reference plane (e.g., the XZ plane mentioned later), or the first gripping member 140 is located on a same side of the reference plane (e.g., the XZ plane mentioned later) as the fixing hook 120, to make the first gripping member 140 avoid the user.

When the user holds the first gripping member 140 to perform the exercise, the first gripping member 140 is at the extended position for the user to hold. When the user grips the second gripping member 150 to perform the exercise, the first gripping member 140 is at the offset position to avoid the first gripping member 140 from interfering with the user's exercise process, providing the user with a better experience and improved safety.

When the exercise device 100 is installed on the horizontal support surface (e.g., the ground), the reference plane is parallel to the horizontal support surface, with user's face facing the horizontal support surface when the user uses the exercise device 100. At this time, when the first gripping member 140 is at the extended position, the first gripping member 140 faces the user's face, for example, with the first gripping member 140 oriented vertically upward, perpendicular to the horizontal support surface. To make the first gripping member 140 avoid the user when the first gripping member 140 is at the offset position, the first gripping member 140 is located in the reference plane (i.e., parallel to the horizontal support surface, such as the ground), or the first gripping member 140 is oriented downward, perpendicular to the horizontal support surface. At this time, the horizontal support surface has sufficient space for accommodating the first gripping member 140.

Figure 3:
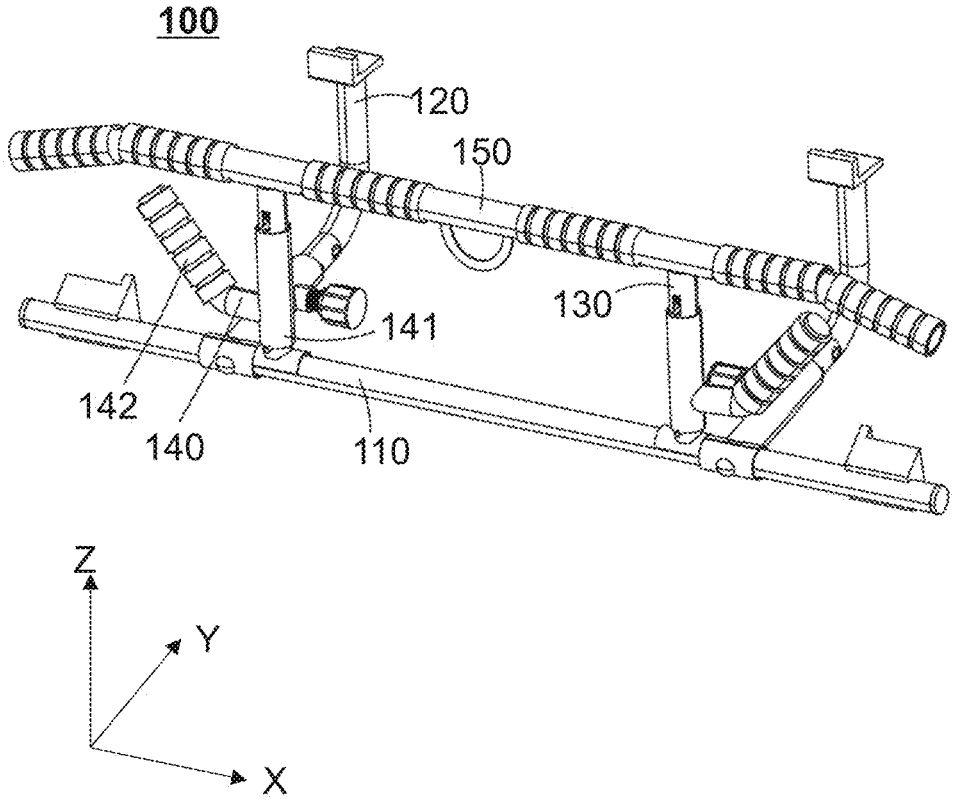
FIG. 3 is a schematic diagram illustrating an exercise device according to some embodiments of the present disclosure.
Figure 4:
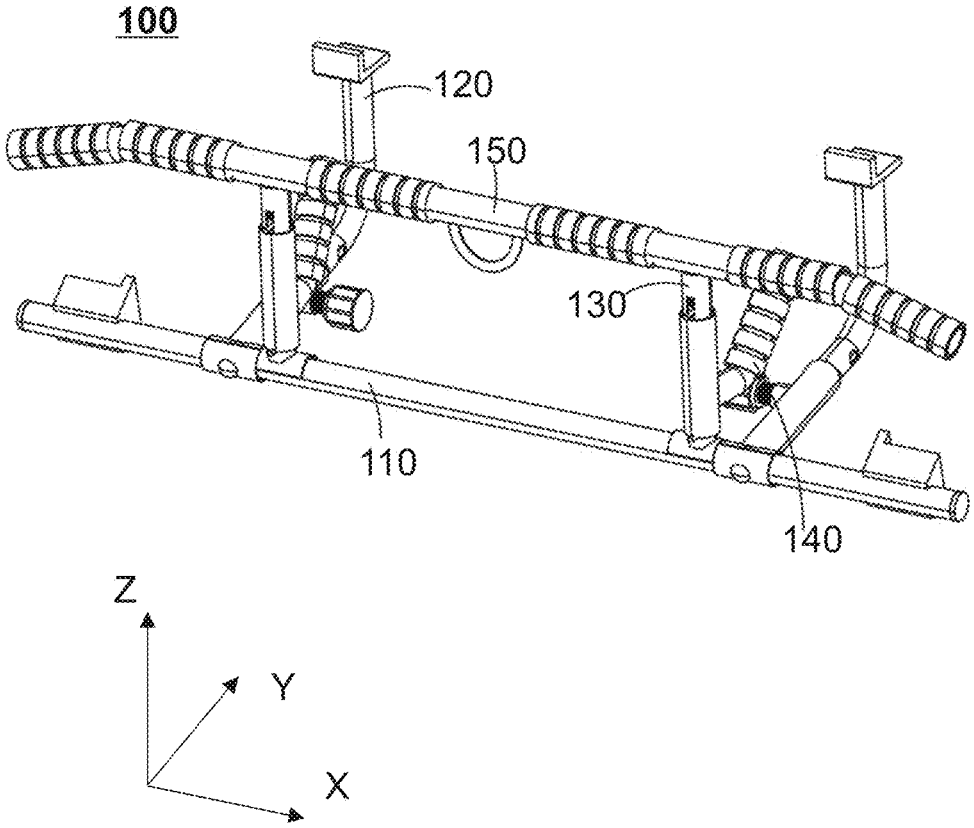
FIG. 4 is a schematic diagram illustrating an exercise device according to some embodiments of the present disclosure.

When the exercise device 100 is mounted on the door frame, the user faces the door frame when using the exercise device 100. At this time, the reference plane is parallel to the plane where the door frame is located. In some embodiments, a width direction of the door frame is defined as an X direction, a height direction of the door frame is defined as a Z direction, and a direction through the door frame is defined as a Y direction. When the exercise device 100 is mounted on the door frame, the X direction is also an axis direction of the fixing rod 110, the Z direction is a height direction of the user when standing, and/or an axis direction of the connecting member 130, and the Y direction is a direction perpendicular to a reference plane formed by the axis of the connecting member 130 and the axis of the fixing rod 110 (i.e., an XZ plane). The plane where the door frame is located is parallel to the XZ plane. The fixing rod 110 and the connecting member 130 (and the reference plane XZ plane) are located on one side of the plane where the door frame is located along the Y direction, and the fixing hook 120 is located on the other side of the plane where the door frame is located along the Y direction. When exercising, the user is located on the same side with the fixing rod 110 on the plane where the door frame is located. At this time, with reference to FIG. 1 and FIG. 2, the first gripping member 140 faces the user's face when the first gripping member 140 is at the extended position, i.e., the first gripping member 140 is located a side facing the user in the XZ plane along the Y direction side, e.g., the first gripping member 140 is perpendicular to the XZ plane and the first gripping member 140 faces a direction away from the fixing hook 120 along the Y direction. Referring to FIG. 3 and FIG. 4, the first gripping member 140 can avoid interference with the user when the first gripping member 140 is at the offset position. For example, when the first gripping member 140 is at the offset position, the axis of the first gripping member 140 is located in the reference plane (i.e., the XZ plane), i.e., the first gripping member 140 is parallel to the plane where the door frame is located, as shown in FIG. 3. Alternatively, when the first gripping member 140 is at the offset position, the first gripping member 140 is on the same side of the reference plane (i.e., the XZ plane) with the fixing hook 120, e.g., the first gripping member 140 is perpendicular to the reference plane (i.e., the XZ plane) and the first gripping member 140 faces the fixing hook 120 along the Y direction.

In some embodiments, to ensure that the first gripping member 140 avoids interference with the user at the offset position, the first gripping member 140 at the offset position is deflected by at least 90° relative to the extended position. That is, the first gripping member 140 rotates for at least 90° from the extended position to reach the offset position. In some embodiments, the first gripping member 140 deflects for 120° 150° or 180° from the extended position to reach the offset position.

Figure 5:
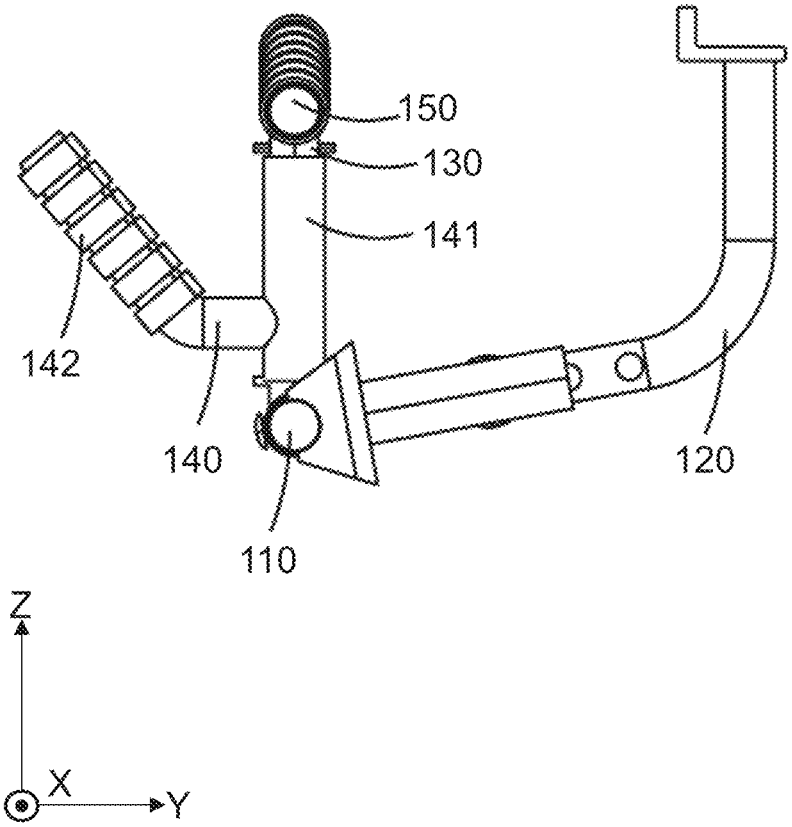
FIG. 5 is a schematic diagram illustrating an exercise device according to some embodiments of the present disclosure.

As shown in FIG. 5, when the exercise device 100 is mounted on the door frame, the second gripping member 150 is disposed above the fixing rod 110 along the Z direction, so that the second gripping member 150 is in a position that is easy for the user to grip.

In some embodiments, in the axis direction (i.e., the X direction) of the fixing rod 110, the fixing hook 120 is disposed between the connecting member 130 and a corresponding end of the fixing rod 110 (i.e., an end close to the connecting member 130). In some embodiments, there are two fixing hooks 120 (referred to as a first fixing hook and a second fixing hook) and two connecting members 130 (referred to as a first connecting member and a second connecting member). The first connecting member and the first fixing hook are disposed near a first end of the fixing rod 110, and in the axis direction (i.e., the X direction) of the fixing rod 110, the first fixing hook is disposed between the first connecting member 130 and the first end of the fixing rod 110; and the second connecting member and the second fixing hook are disposed near a second end of the fixing rod 110, and in the axis direction (i.e., the X direction) of the fixing rod 110, the second fixing hook is disposed between the second connecting member and the second end of the fixing rod 110, as shown in FIGS. 1-4. In this way, a spacing between the two fixing hooks 120 is greater, which allows the exercise device 100 to be adapted to a wider door spacing and improves a stability of a connection between the exercise device 100 and the door frame.

In some other embodiments, in the axis direction (i.e., the X direction) of the fixing rod 110, the connecting member 130 is located between the fixing hook 120 and the corresponding end of the fixing rod 110, resulting in a smaller spacing between the two fixing hooks 120, allowing the exercise device 100 to be adapted to a narrower door spacing.

In some embodiments, the second gripping member 150 is disposed parallel to the fixing rod 110 for ease of grip by the user. In some embodiments, the second gripping member 150 is provided with a second gripping portion 151 and a third gripping portion 152, the third gripping portion 152 being closer to an end portion of the second gripping member 150 than the second gripping portion 151. In some embodiments, there are two second gripping portions 151 and two third gripping portions 152 to facilitate the gripping of the user, and the two second gripping portions 151 are disposed between the two third gripping portions 152, as shown in FIGS. 1-4. The second gripping portions 151 and the third gripping portions 152 provide the user with different gripping parts to adapt to different widths of open arms so that the user exercises through different postures.

In some embodiments, to avoid interference with the grip of the user by the connecting member 130, the connecting member 130 is disposed in the axis direction (i.e., X direction) of the fixing rod 110 between the second gripping portion 151 and the third gripping portion 152 adjacent to each other, as shown in FIGS. 1-4.

In some embodiments, the end portion of the second gripping member 150 is also provided with a fourth gripping portion 153, and the fourth gripping portion 153 provides the user with a greater width of open arms to improve a user experience.

In some embodiments, in the axis direction (i.e., the Z direction) of the connecting member 130, the fourth gripping portion 153 extends toward the fixing rod 110, i.e., the fourth gripping portion 153 extends downwardly in the Z direction, as shown in FIGS. 1-4. Since the second gripping member 150 disposed parallel to the fixing rod 110, the second gripping portion 151 and the third gripping portion 152 are horizontal gripping portions, while the fourth gripping portion 153 is a downwardly inclined gripping portion. An arm span angle and a palm incline angle corresponding to the horizontal gripping portion are greater than an arm span angle and a palm incline angle corresponding to the downwardly inclined gripping portion. By disposing the second gripping portion 151, the third gripping portion 152, and the fourth gripping portion 153, the user is able to adopt exercise postures corresponding to different levels of difficulty, which satisfies diversified exercise needs of the user.

In some other embodiments, the fourth gripping portion 153 is a horizontal gripping portion. By disposing a plurality of horizontal gripping portions, the exercise device 100 is made to meet and adapt to physical conditions and exercise needs of different users and adapt to more users.

In some embodiments, the first gripping member 140 is removably connected (e.g., via snap-fit connection, bolted connection, etc.) to the connecting member 130. Correspondingly, when the first gripping member 140 is mounted on the connecting member 130, the first gripping member 140 is at the extended position or at the offset position. For example, when the first gripping member 140 is installed on the connecting member 130 in a preset specific posture, the first gripping member 140 is at the extended position; when the first gripping member 140 is installed on the connecting member 130 in another posture, the first gripping member 140 is at the offset position. When the first gripping member 140 is removed from the connecting member 130, the first gripping member 140 is switched from the offset position to the extended position because the first gripping member 140 no longer interferes with the user. In other words, the first gripping member 140 at the disassembled state may be regarded as at the offset position.

In some embodiments, the first gripping member 140 is rotationally connected to the connecting member 130. A switching of the first gripping member 140 between the extended position and the offset position is achieved by the rotation of the first gripping member 140 relative to the connecting member 130.

Referring to FIGS. 1-5, in some embodiments, a fixed end of the first gripping member 140 is rotationally connected to the connecting member 130 through a sleeve 141. Specifically, the sleeve 141 is coaxially disposed outside of connecting member 130, and the fixed end of the first gripping member 140 is fixed to a circumferential side of the sleeve 141. In some embodiments, the first gripping portion 142 is disposed at a free end of the first gripping member 140. When the first gripping member 140 is at the extended position, the first gripping portion 142 extends toward the second gripping member 150 in the axis direction (i.e., the Z direction) of the connecting member 130, i.e., the first gripping portion 142 extends upwardly in the Z direction as shown in FIG. 5, to facilitate gripping by the user.

In some embodiments, the connecting member 130 is provided with a first locking portion, the sleeve 141 is provided with a second locking portion, and the first locking portion and the second locking portion cooperate to hold the first gripping member 140 at the extended position, to avoid the user from moving or deflecting the first gripping member 140 when the first gripping member 140 is held for exercise, thereby improving stability and safety of use.

Figure 6:
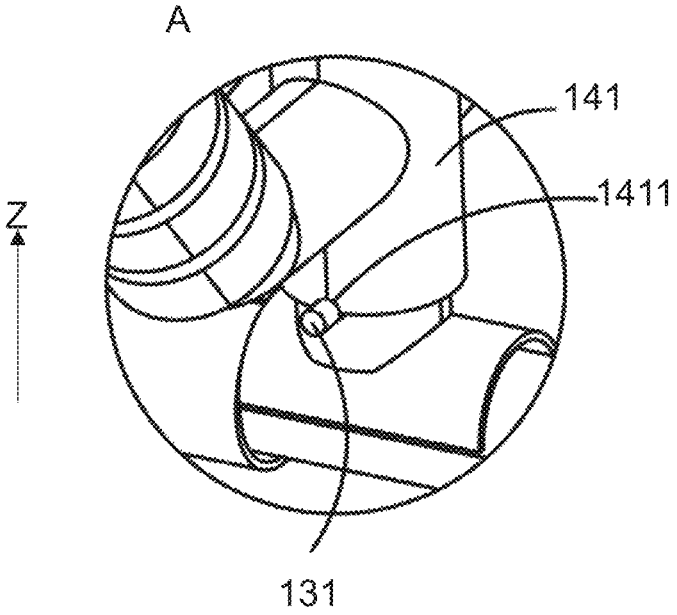
FIG. 6 is an enlarged schematic diagram of region A in FIG. 1.

FIG. 6 is an enlarged schematic diagram of region A in FIG. 1.

Referring to FIG. 6, in some embodiments, the first locking portion includes a limiting block 131 disposed at an end of the connecting member 130 proximate to the fixing rod 110, and the second locking portion includes a limiting groove 1411 disposed at an end of the sleeve 141 facing the fixing rod 110. When the first gripping member 140 is at the extended position, the limiting block 131 is snapped into the limiting groove 1411, and the limiting groove 1411 cooperates with the limiting block 131 to limit a degree of freedom of the sleeve 141 and the first gripping member 140 rotating around the axis of the connecting member 130 relative to the connecting member 130, thereby improving an installation stability when the first gripping member 140 is at the extended position, and improving the safety of use.

When the user grips at the first gripping position 142 of the first gripping member 140, due to an action of gravity, the sleeve 141 is subjected to a downward force along an axis direction of the connecting member 130, so that the limiting block 131 abuts against a bottom of the limiting groove 1411, thereby avoiding the sleeve 141 from sliding up and down relative to the connecting member 130 along the axis direction of the connecting member 130, and improving the safety of use.

In some embodiments, to avoid the limiting block 131 from slipping out of the limiting groove 1411 and improve the installation stability and the safety of use of the first gripping member 140 when the first gripping member 140 is at the extended position, a shape of the limiting block 131 is prismatic and a shape of the limiting groove 1411 corresponds to the shape of the limiting block 131, to facilitate the limiting block 131 and the limiting groove 1411 to snap together to realize position limiting.

In some embodiments, a size of the limiting groove 1411 is designed to further improve the installation stability and the safety of use when the first gripping member 140 is at the extended position. Specifically, in the axis direction of the sleeve 141 (i.e., the axis direction of the connecting member 130), the size of the limiting groove 1411 may be greater than the size of the limiting block 131 (e.g., the limiting groove 1411 is in an inverted long U shape, and the limiting block 131 is located at the bottom of the groove after entering the limiting groove 1411, and the limiting block 131 does not extend out of the limiting groove 1411). When the first gripping member 140 is at the extended position, the limiting block 131 is completely disposed within the limiting groove 1411, thereby further preventing the limiting block 131 from slipping out of the limiting groove 1411.

Referring to FIG. 1, in some embodiments, the first locking portion also includes a positioning member 132, the connecting member 130 is also provided with a slotted hole 133 in the axis direction of the connecting member 130, the positioning member 132 is provided in the slotted hole 133 and extends out of the slotted hole 133 to abut against the end of the sleeve 141, an elastic member (not shown in the figure) is provided within the connecting member 130 with one end fixed and the other end connected to the positioning member 132. The elastic member is configured to apply a force to the positioning member 132 such that the positioning member 132 is limited against the end portion of the sleeve 141, and the elastic member cooperates with the positioning member 312 in limiting a degree of freedom of the sleeve 141 to slide with the first gripping member 140 relative to the connecting member 130 in the axis direction of the connecting member 130.

In some embodiments, the slotted hole 133 is disposed in a region of the connecting member 130 proximate to the second gripping member 150, the positioning member 132 abuts against an end of the sleeve 141 facing the second gripping member 150, and an end of the sleeve 141 toward the fixing rod 110 abuts against the fixing rod 110, thereby limiting the sleeve 141. When the sleeve 141 moves upward in the axis direction of the connecting member 130, the positioning member 132 is driven to move upward in the axis direction of the connecting member 130 in the slotted hole 133, and the elastic member has a restoring force that moves downward along the axis direction of the connecting member 130, and drives the positioning member 132 to apply a force downward in the axis direction of the connecting member 130 on the sleeve 141 to limit the sleeve 141.

In some embodiments, one end of the elastic member is connected to the fixing rod 110 (or the end of the connecting member 130 facing the fixing rod 110), and the other end of the elastic member is connected to the positioning member 132. When the sleeve 141 moves upward in the axis direction of the connecting member 130, the positioning member 132 is driven to move upward in the axis direction of the connecting member 130 in the slotted hole 133, and the elastic member is stretched with a restoring force downward along the axis direction of the connecting member 130.

In some embodiments, one end of the elastic member is connected to the second gripping member 150 (or the end of the connecting member 130 facing the second gripping member 150), and the other end of the elastic member is connected to the positioning member 132. When the sleeve 141 moves upward in the axis direction of the connecting member 130, the positioning member 132 is driven to move upward in the axis direction of the connecting member 130 in the slotted hole 133, and the elastic member compresses with a restoring force downward in the axis direction of the connecting member 130.

In some embodiments, the connecting member 130 is proximate to the limiting block 131 at one end of the fixing rod 110, and the sleeve 141 faces the limiting groove 1411 at one end of the fixing rod 110; meanwhile, the slotted hole 133 is provided in a region at the other end of the connecting member 130 proximate the second gripping member 150, the slotted hole 133 is provided with the positioning member 132, and the connecting member 130 is provided with the elastic member inside the connecting member 130, one end of the elastic member is fixed, and the other end of the elastic member is connected to the positioning member 132.

When the first gripping member 140 is at the extended position, the limiting block 131 is disposed in the limiting groove 1411 at one end of the sleeve 141, and the other end of the sleeve 141 abuts against the positioning member 132. When the first gripping member 140 switches from the extended position to the offset position, the first gripping member 140 moves upward in the axis direction of the connecting member 130 to move the limiting block 131 out of the limiting groove 1411, to make the sleeve 141 be rotatable relative to the connecting member 130, thereby realizing the switching of the first gripping member 140 between the extended position and the offset position. When the first gripping member 140 switches to the offset position, under the action of the elastic member, the positioning member 132 drives the sleeve 141 downward in the axis direction of the connecting member 130 until the end of the sleeve 141 facing the fixing rod 110 (or another limiting groove provided on the end) abuts against the fixing rod 110 or the limiting block 131, to keep the sleeve 141 at the offset position. When the first gripping member 140 switches from the offset position to the extended position, the first gripping member 140 moves upward in the axis direction of the connecting member 130, so that the limiting block 131 moves out of the limiting groove 1411 and the sleeve 141 is able to rotate relative to the connecting member 130, thereby realizing the switching of the first gripping member 140 between the extended position and the offset position. When the first gripping member 140 switches to the extended position, under the action of the elastic member, the positioning member 132 drives the sleeve 141 to move downward in the axis direction of the connecting member 130 until the limiting block 131 enters the limiting groove 1411 provided at the end of the sleeve 141 facing one end of the fixing rod 110 and abuts against the limiting groove 1411, so that the sleeve 141 is maintained at the extended position.

Figure 7:
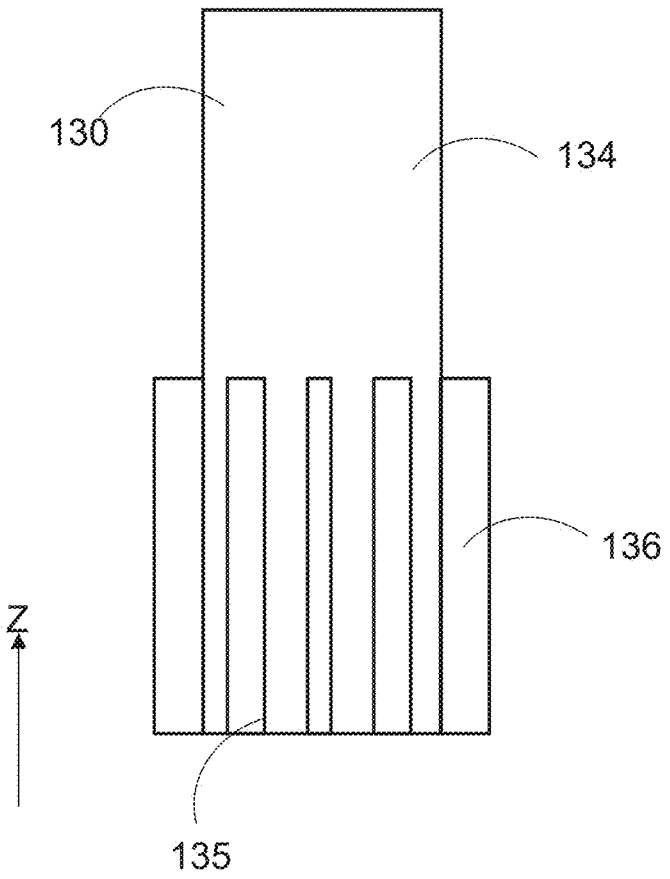
FIG. 7 is a schematic diagram illustrating a connecting member according to some embodiments of the present disclosure.
Figure 8:
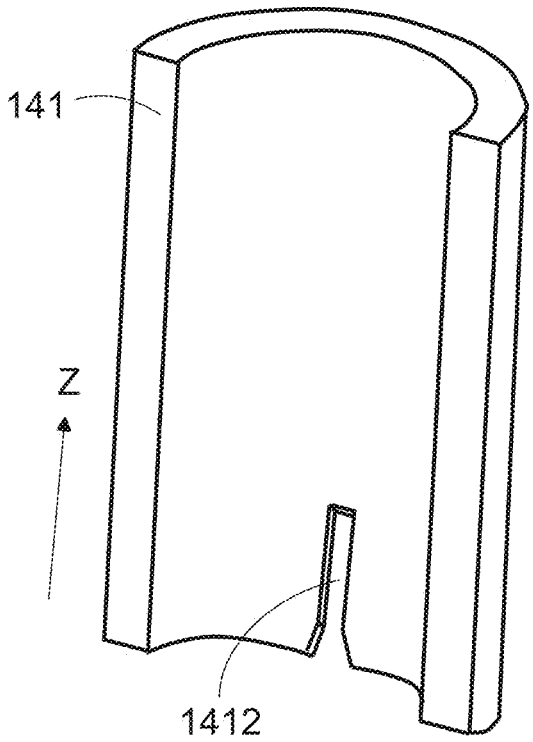
FIG. 8 is a schematic diagram illustrating a guiding groove according to some embodiments of the present disclosure.

FIG. 7 is a schematic diagram illustrating a connecting member according to some embodiments of the present disclosure, and FIG. 8 is a schematic diagram illustrating a guiding groove according to some embodiments of the present disclosure.

Referring to FIG. 7 and FIG. 8, the connecting member 130 includes a limiting region 135 near the fixing rod 110 and a rotation region 134 away from the fixing rod 110. The first locking portion includes at least one guiding strip 136 disposed in the limiting region 135, the second locking portion includes at least one guiding groove 1412 disposed on the inner wall of the sleeve 141, and the at least one guiding strip 136 and the guiding groove 1412 cooperate with each other to limit the sleeve 141 and the first gripping member 140.

When the sleeve 141 slides to the rotation region 134 along an axis direction of the sleeve 141 (i.e., an axis direction of the connecting member 130), the at least one guiding strip 136 moves out of the corresponding guiding groove 1412 from an opening of the guiding groove, thereby separating the at least one guiding strip 136 and the guiding groove 1412, releasing the cooperation between the at least one guide strip 136 and the guiding groove 1412, enabling the sleeve 141 to rotate relative to the connecting member 130 and enabling the first gripping member 140 to be switched between an extended position and an offset position. When the first gripping member 140 moves to the extended position or the offset position, the sleeve 141 slides in the axis direction of the sleeve 141 (i.e., in the axis direction of the connecting member 130) to the limiting region 135 when the guiding strip 136 enters the corresponding guiding groove 1412 from the opening of the guiding groove 1412, so that the first gripping member 140 is maintained in the extended or offset position.

In some embodiments, to reduce a difficulty of matching the guiding groove 1412 with the guide strip 136 and to make it easy for the strip 136 to enter the guiding groove 1412, the opening at an end of the guiding groove 1412 facing the fixing rod 110 (i.e., the end at which the guide strip 136 enters or moves out of the guiding groove 1412) is a flared opening, as shown in FIG. 8.

In some embodiments, the first locking portion includes a plurality of elastic protrusions disposed on an outer wall of the connecting member 130, and the second locking portion includes a plurality of grooves disposed on the inner wall of the sleeve 141. The plurality of elastic protrusions and the plurality of grooves are in one-to-one correspondences. When the first gripping member 140 is at the extended position, the plurality of elastic protrusions enter the corresponding grooves to limit the first gripping member 140, so that the first gripping member 140 is maintained at the extended position. When the first gripping member 140 needs to be switched between the extended position and the offset position, a force is applied to the first gripping member 140 to make it rotate with respect to the connecting member 130, the plurality of elastic protrusions are deformed and disengage from the plurality of grooves, thereby realizing the switching of the first gripping member 140 between the extended position and the offset position. When the first gripping member 140 is at the offset position, each of the plurality of elastic protrusions enters another groove.

It should be noted that in some other embodiments, the first locking portion includes a plurality of grooves disposed on the outer wall of the connecting member 130, and the second locking portion includes a plurality of elastic protrusions disposed on the inner wall of the sleeve 141, the plurality of elastic protrusions and the plurality of grooves are in one to one correspondences.

Referring to FIG. 5, an overall contour of the exercise device 100 is relatively large when in use, occupying a significant amount of space, which is not conducive to portability and storage. To improve the portability of the exercise device 100, reduce the difficulty of storing the exercise device 100, and reduce the space occupied by the exercise device 100, in some embodiments, the fixing hook 120 and the fixing rod 110 are rotationally connected and/or provided with a loosening or tightening adjustment structure. Via the loosening or tightening adjustment structure, the rotation between the fixing hook 120 and the fixing rod 110 can be locked or unlocked. By disposing the fixing hook 120 and through the switching function of the first gripping member 140 between the extended position and the offset position, the space occupied by the exercise device 100 when it is not in use (e.g., during transportation or home storage) may be effectively saved. Specifically, when the exercise device 100 is not in use, the fixing hook 120 rotates to a position that fits or is close to the connecting member 130 as well as the second gripping member 150, and at the same time, the first gripping member 140 is adjusted to the offset position (e.g., by rotating 90 degrees). In such cases, the first gripping member 140 is substantially coplanar with the fixing rod 110, the connecting member 130, and the second gripping member 150, thereby an overall contour of the exercise device 100 is made to be approximately flat for easy transportation and storage.

In some embodiments, the fixing hook 120 is removably connected to the fixing rod 110. When in use, the fixing hook 120 is mounted on the fixing rod 110. When not in use, the fixing hook 120 is removed. In such an arrangement, the space occupied by the exercise device 100 is reduced, the portability of the exercise device 100 is improved, and the difficulty of storing the exercise device 100 is reduced.

In some embodiments, the fixing hook 120 is selectively installed at different positions on the fixing rod 110, so that a distance between different fixing hooks 120 is adjusted to fit door frames with different door pitches, thereby enhancing a using range of the exercise device 100.

In some embodiments, a plurality of mounting holes are provided at intervals along the axis direction (i.e., an X direction) of the fixing rod 110, and the fixing hook 120 is selectively mounted on any of the mounting holes through a mounting member.

Figure 9:
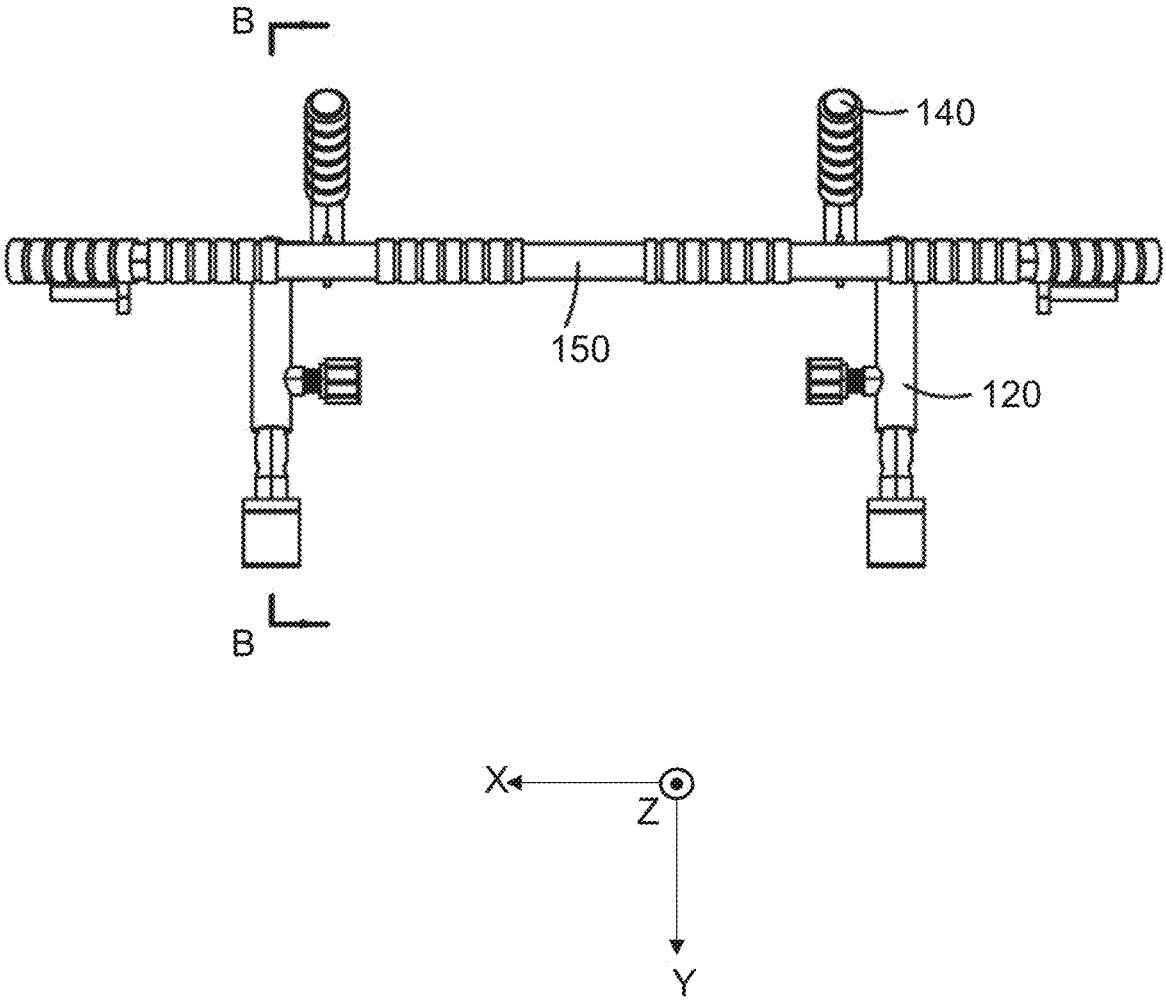
FIG. 9 is a schematic diagram illustrating an exercise device according to some embodiments of the present disclosure.
Figure 10:
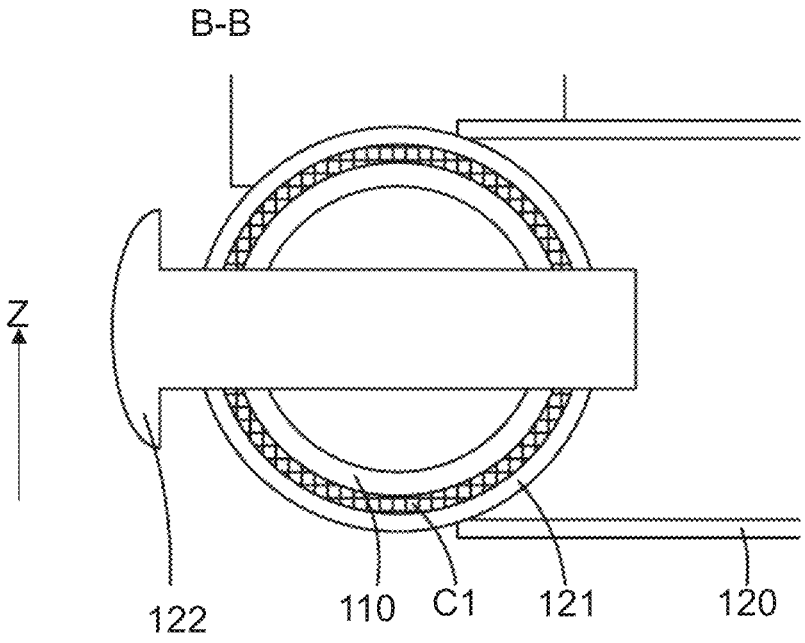
FIG. 10 is a schematic diagram illustrating a profile corresponding to B-B shown in FIG. 9.
Figure 11:
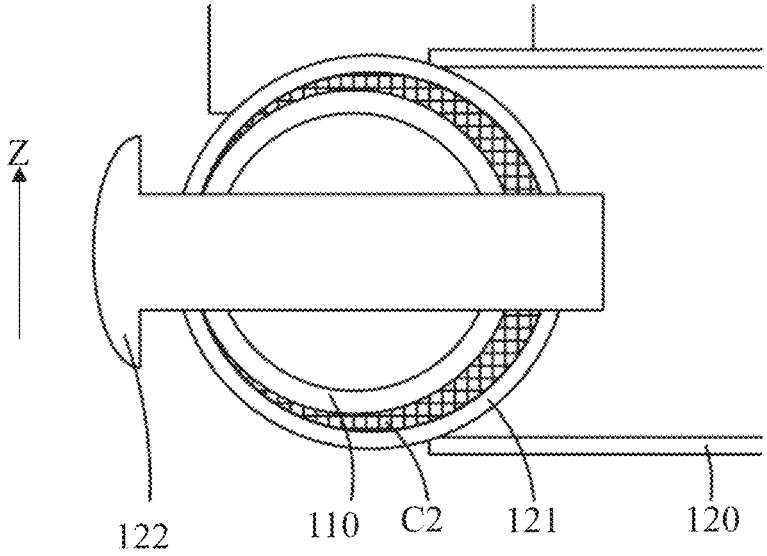
FIG. 11 is a schematic diagram illustrating a connection between a fixing hook and a fixing rod according to some embodiments of the present disclosure.
Figure 12:
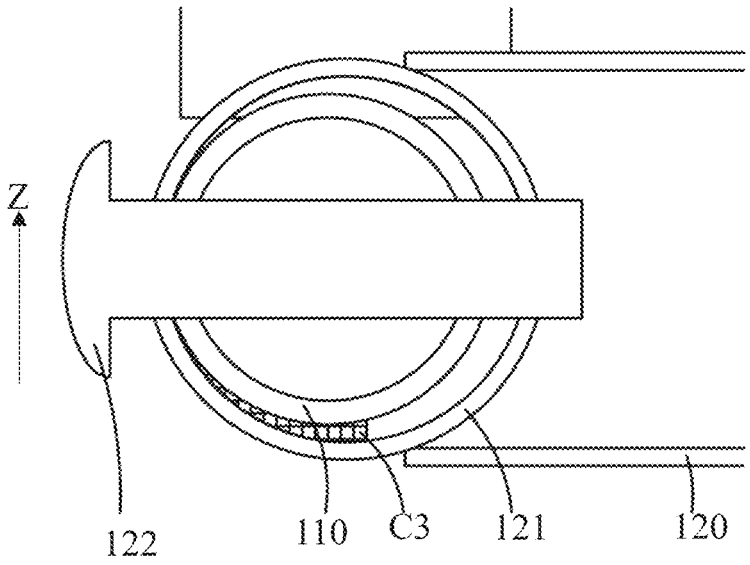
FIG. 12 is a schematic diagram illustrating an alternative connection between a fixing hook and a fixing rod according to some embodiments of the present disclosure.
Figure 13:
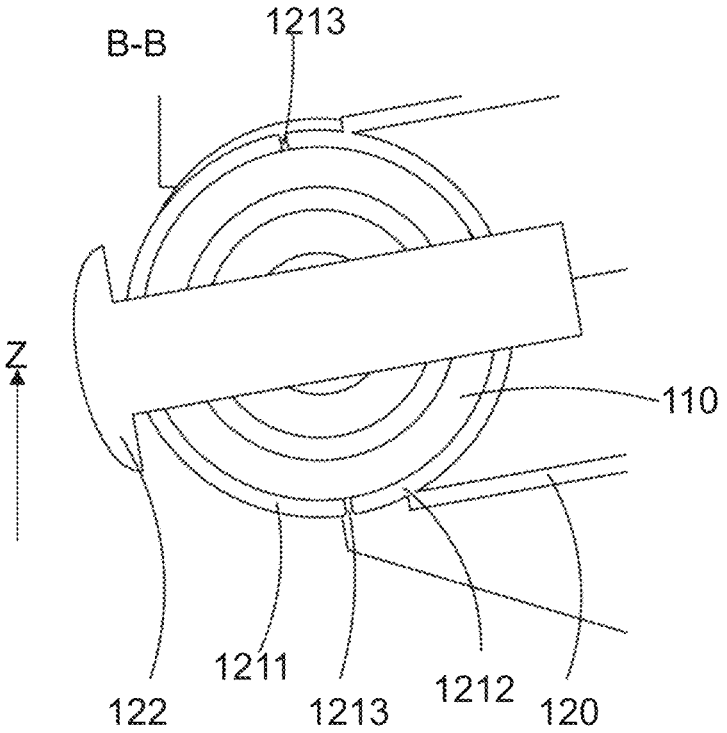
FIG. 13 is a schematic diagram illustrating another connection between a fixing hook and a fixing rod according to some embodiments of the present disclosure.

FIG. 9 is a schematic diagram illustrating an exercise device according to some embodiments of the present disclosure. FIG. 10 is a schematic diagram illustrating a profile corresponding to B-B shown in FIG. 9. FIG. 11 is a schematic diagram illustrating a connection between a fixing hook and a fixing rod according to some embodiments of the present disclosure. FIG. 12 is a schematic diagram illustrating an alternative connection between a fixing hook and a fixing rod according to some embodiments of the present disclosure. FIG. 13 is a schematic diagram illustrating another connection between a fixing hook and a fixing rod according to some embodiments of the present disclosure.

Referring to FIG. 1, FIG. 9, and FIG. 10, in some embodiments, the fixing hook 120 is installed on the fixing rod 110 via the tube 121, the fixing hook 120 is fixedly connected to the tube 121, the tube 121 is sleeved on the fixing rod 110, and the tube 121 is fixedly connected to the fixing rod 110 by a bolt 122.

In some embodiments, the fixing rod 110 is provided with a mounting hole, and the bolt 122 penetrates through the tube 121 and the mounting hole to realize a connection between the tube 121 and the fixing rod 110.

In some embodiments, the bolt 122 acts as a loosening or tightening adjustment structure that locks or unlocks a rotation between the tube 121 (the fixing hook 120) and the fixing rod 110. When the bolt 122 passes through the tube 121 and the mounting hole, it locks the rotation between the tube 121 and the fixing rod 110; when the bolt 122 moves out of the mounting hole, it unlocks the rotation between the tube 121 and the fixing rod 110.

In some embodiments, the bolt 122 also enables a removable connection between the tube 121 (the fixing hook 120) and the fixing rod 110. When the bolt 122 penetrates the tube 121 and the mounting hole, a mounting connection between the tube 121 (the fixing hook 120) and the fixing rod 110 is realized; when the bolt 122 moves out of the mounting hole, the tube 121 moves out of the fixing rod 110, thus realizing a disassembly between the fixing hook 120 and the fixing rod 110.

In some embodiments, the bolt 122 also serves as an installation member, and the bolt 122 fixes the tube 121 to mounting holes at different positions on the fixing rod 110, thereby allowing the fixing hook 120 to be installed at different positions on the fixing rod 110.

In some embodiments, neither end of the bolt 122 passes into the fixing hook 120, i.e., both ends of the bolt 122 are exposed (e.g., a length direction of the bolt 122 is parallel to the Z axis direction), thereby facilitating a removal of the bolt 122.

In some embodiments, referring to FIG. 10, a tail end of the bolt 122 is threaded into the fixing hook 120 and located in the fixing hook 120. At this time, a middle section of the bolt 122 is hidden in the tube 121 and the fixing rod 110, and only a top of the bolt 122 is exposed out of the tube 121, making the exercise device 100 more compact and aesthetically pleasing as a whole.

In some embodiments, a hole portion on a side of the tube 121 that is threaded out by the bolt 122 (i.e., the side of the tube 121 that is near the end of the bolt 122, e.g., the side of the tube 121 shown in FIG. 10 near the fixing rod 110) is a threaded hole, and the hole portion on the side of the tube 121 that is threaded in by the bolt 122 (i.e., the side of the tube 121 that is near a top of the bolt 122, e.g., the side of the tube 121 shown in FIG. 10 away from the fixing rod 110) is a smooth hole. As it is necessary to ensure that the tube 121 is smoothly set into the fixing rod 110, an installation space needs to be reserved between the tube 121 and the fixing rod 110, i.e., a textured filling region C1 as shown in FIG. 10. As shown in FIG. 11, the tube 121 is pushed up in a process of tightening the bolt 122, and an unequal internal space on two sides is eventually formed between the tube 121 and the fixing rod 110, i.e., a textured filling region C2 as shown in FIG. 11. As shown in FIG. 12, when the user exercises (e.g., pull-ups), the fixing hook 120 hangs securely on the top of the door frame, and the exercise device 100 as a whole is subjected to a downward pulling force, the fixing rod 110 has a tendency to bend and deform downwardly, and the fixing rod 110 enters a textured filling region C3 as shown in FIG. 12, and ultimately fits a lower region of a side of an inner wall of the tube 121 facing the user (e.g., a lower left side of the inner wall of the tube 121 as shown in FIG. 12). Through the above design of the hole portion through which the bolt 122 passes, the fixing rod 110 has a downward bending and deformation space, and the fixing rod 110 transfers a force to the tube 121, making the fixing rod 110 and the tube 121 bear the force together, thereby enhancing the stability and safety of the exercise device 100.

Referring to FIG. 13, in some embodiments, the tube 121 includes a first annular sheet 1211 and a second annular sheet 1212. The first annular sheet 1211 and the second annular sheet 1212 are adapted respectively to two sides corresponding to two ends of the mounting hole of the fixing rod 110. The fixing hook 120 is fixedly connected to the second annular sheet 1212, and the bolt 122 passes through the first annular sheet 1211, the fixing rod 110, and the second annular sheet 1212 sequentially, thereby realizing the connection between the fixing hook 120 and the fixing rod 110.

In some embodiments, a gap 1213 is provided between the first annular sheet 1211 and the second annular sheet 1212 along a user exercise direction (a Z direction). By the setting of the gap 1213, when the user exercises, the exercise device 100 bears a downward force along the Z direction, the first annular sheet 1211 is able to be deflected downwardly in the Z direction around the axis of the fixing rod 110, and the corresponding gap 1213 decreases until the first annular sheet 1211 and the second annular sheet 1212 abut against each other to bear the force together, thereby improving an overall force bearing capacity of the exercise device 100, and improving the stability and safety of the exercise device 100. At the same time, as an offset direction and an offset amount of the first annular sheet 1211 are relatively fixed, a shaking and a noise of a fitting process are effectively reduced.

In some other embodiments, the first annular sheet 1211 is fixedly connected (e.g., welded, etc.) to the fixing rod 110, and the second annular sheet 1212 and the fixing hook 120 are removably connected to the fixing rod 110.

In some embodiments, the fixing hook 120 includes a telescoping structure, which allows a length of the fixing hook 120 adjustable to fit the door frames with different thicknesses, while reducing an amount of space the fixing hook 120 occupies when not in use (e.g., when stored). For example, the fixing hook 120 includes the c similar to a clothesline pole (not shown in the figures), etc.

Since the end portion of the connecting member 130 has a relatively small size, if an end portion of the connecting member 130 is directly connected to the fixing rod 110, the connection/contact surface between the two is relatively small, and a force-bearing capacity is limited. To improve a strength of the connection between the connecting member 130 and the fixing rod 110, referring to FIG. 1, the end of the connecting member 130 facing the fixing rod 110 is disposed with a widening plate 137. The widening plate 137 is connected to the fixing rod 110, and a shape of the widening plate 137 is adapted to a shape of the fixing rod 110. By providing the widening plate 137, the connecting/contacting surface between the connecting member 130 and the fixing rod 110 is enlarged to improve the force-bearing capacity. In some embodiments, a fixing manner between the widening plate 137 and the fixing rod 110 includes, but is not limited to, welding, bolt-nut connection, etc.

Referring to FIG. 1, in some embodiments, the second gripping member 150 is provided with a connecting ring 154, which is used to connect a stretch fitness appliance (not shown in the figures). The stretch fitness appliance refers to a kind of appliances for the user to exercise by stretching, including but not limited to elastic bands, tensile bands, resistance bands, etc. The stretching fitness appliance may only include a band body, or may be equipped with additional handles on the band body. It should be noted that the stretch fitness appliance is used in conjunction with the exercise device 100 but does not form an integral part of the exercise device 100.

In some embodiments, an installation manner between the connecting ring 154 and the second gripping member 150 includes, but is not limited to, a fixed connection, a rotational connection, etc. Exemplarily, the fixed connection includes welding or a bolt-nut connection, etc., and the rotational connection is an internal jacket connection, etc.

In some embodiments, to avoid the connecting ring 154 from interfering with a gripping position (e.g., the second gripping portion 151, the third gripping portion 152, etc.), the connecting ring 154 is disposed in a middle portion of the second gripping member 150 as shown in FIG. 1.

The connecting ring 154 is disposed so that the exercise device 100 is paired with an external stretching fitness appliance, thereby increasing stretching exercise options. The user may tie the stretching fitness appliance to the connecting ring 154, or may just wrap the stretching fitness appliance around and leave it untied, i.e., the middle portion of the stretching fitness appliance is wrapped around the connecting ring 154, with one end going downward through the connecting ring 154, and the other end going upward through the connecting ring 154, so that the user pull outwardly to perform the exercise using the connecting ring 154 as a fixing point.

In some embodiments, to increase a friction between the user and the gripping portion and avoid slippage when the user grips, the gripping portion (e.g., the first gripping portion 142, the second gripping portion 151, the third gripping portion 152, the fourth gripping portion 153, etc.) is provided with an anti-slip layer, such as a foam layer, an adhesive sleeve layer, etc.

In some embodiments, the exercise device 100 further includes a sensor assembly, and the sensor assembly includes one or more mechanics sensors. The one or more mechanics sensors are able to detect the exercise condition of the user (e.g., force exertion condition).

In some embodiments, the first gripping portion 142 of the first gripping member 140 is provided with at least one mechanics sensor. It should be noted that the first gripping portions 142 of the two first gripping members 140 are each provided with a mechanics sensor. When the at least one mechanics sensor obtains triggering information, it indicates that the user is holding the first gripping portion 142 to perform the exercise, thereby determining a standard exercise posture and standard exercise muscles of the user. In some embodiments, the one or more mechanics sensors obtain actual mechanics information of the user, thereby obtaining a force curve of the user. Combining the standard exercise posture of the user, an exercise effect of the user is analyzed and determined, to provide the user with exercise feedback information.

In some embodiments, the second gripping portion 151, the third gripping portion 152, and the fourth gripping portion 153 are each provided with at least one mechanics sensor. When a specific mechanic sensor obtains triggering information, based on a set position corresponding to the specific mechanic sensor, the gripping portion held by the user is determined, which in turn determines the standard exercise posture and the standard exercise muscles of the user.

In some embodiments, the sensor assembly also includes an optical sensor (e.g., a camera, a camcorder, etc.), and the optical sensor is used to shoot the actual exercise posture and the corresponding actual exercise muscles of the user. In some embodiments, the optical sensor is disposed at any position that is not obstructed and able to shoot the actual exercise posture of the user. For example, the optical sensor is disposed directly in front of or directly behind the user, etc. In some embodiments, the optical sensor is an external sensor, such as a home monitor, etc.

In some embodiments, the actual exercise posture and the corresponding actual exercise muscles of the user obtained by the optical sensor are verified based on a standard exercise posture and the corresponding standard exercise muscles (e.g., which are determined based on the mechanics sensor) to improve data accuracy.

In some embodiments, the exercise device 100 further includes a processor. The processor is configured to (1) obtain triggering information and actual mechanics information of the one or more mechanics sensors; (2) determine exercise standard information based on the triggering information and user information; (3) obtain an optical image of the user; and (4) determine the exercise effect of the user based on the optical image, the exercise standard information, and the actual mechanics information.

In some embodiments, the triggering information of a mechanics sensor refers to information indicating that the mechanics sensor is triggered (i.e., the mechanics sensor is subjected to a force to start sensing). The actual mechanics information refers to the sensing information output when the mechanics sensor is triggered.

In some embodiments, the user information includes information such as a height, a weight, an arm span, etc. of the user. The exercise standard information includes one or more standard exercise postures, the standard exercise muscles corresponding to each standard exercise posture, standard mechanics information corresponding to each standard exercise posture, etc. In some embodiments, the processor determines the gripping position corresponding to the mechanics sensor based on the triggering information; and determines the standard exercise posture corresponding to the gripping position based on the user information and the gripping position. Further, the processor determines the standard exercise muscles and the standard mechanics information of the user corresponding to the standard exercise posture based on the standard exercise posture and the user information. For example, when the user holds the first gripping portion 142 or the second gripping portion 151 to perform pull-ups, the user's hands are less spaced apart, a width of the open arms is smaller, and biceps muscles are mainly exercised. For example, when the user performs the pull-ups while holding the third gripping portion 152 or the fourth gripping portion 153, the user's hands are more widely spaced and the width of the open arms is wider, and back muscles are mainly exercised.

In some embodiments, the processor determines the exercise effect of the user based on the optical image, the actual mechanics information, as well as exercise standard information (e.g., the standard mechanics information, the standard exercise posture, etc.). Exemplarily, the user determines the exercise effect based on a difference between the standard mechanics information and the actual mechanics information. The smaller the difference between the actual mechanics information and the standard mechanics information, the better the exercise effect.

In some embodiments, the processor also determines the actual exercise posture of the user based on the optical image. The determining the exercise effect of the user based on the optical image, the exercise standard information, and the actual mechanics information includes: determining the exercise effect of the user based on the actual exercise posture, the standard exercise posture, the actual mechanics information, and the standard mechanics information. The closer the actual exercise posture of the user is to the standard exercise posture, and the closer the actual mechanics information is to the standard mechanics information, the better the exercise effect.

In some embodiments, the processor is also configured to: determine the standard exercise posture of the user based on the optical image and the triggering information. In some embodiments, a single gripping position corresponds to a plurality of standard exercise postures, thus it is difficult to determine which corresponding standard exercise posture the user is using based on the triggering information from the mechanics sensors corresponding to the grip position alone. At this point, the corresponding standard exercise posture is determined by combining the actual exercise posture (which is determined by the optical image of the user) and the triggering information.

In some embodiments, the optical image includes a muscle image of the user. The processor is also configured to make corrections to the exercise effect based on the muscle image. In some embodiments, to improve the accuracy of the data, by comparing the muscle image and the standard exercise muscle corresponding to the standard exercise posture, whether the user has performed the exercise on the standard exercise muscle corresponding to the standard exercise posture is determined. When the actual exercise muscles of the user and the standard exercise muscles corresponding to the standard exercise posture have a high overlapping degree (for example, when the overlap is close to 1), it means that the aforementioned determined exercise effect is accurate; when the actual exercise muscles of the user and the standard exercise muscles corresponding to the standard exercise posture have a low overlapping degree (for example, when the overlap is less than 0.6), it means that the aforementioned determined exercise effect is less accurate. The overlapping degree refers to a ratio of an overlapping portion between the actual exercise muscles corresponding to the actual exercise posture and the standard exercise muscles corresponding to the standard exercise posture. In some embodiments, the determination of the exercise effect is corrected based on the overlapping degree.

In some embodiments, the processor is also configured to archive historical information about relevant data (e.g., the exercise effect, the actual mechanics information, the exercise standard information, the optical image, etc.) to create a personalized profile of the user, which facilitates the user to compare the exercise effects of different standard exercise postures, and to improve the exercise efficiency of the user. In some embodiments, the exercise device 100 further includes a communication module, the communication module is connected to the processor, and the processor is configured to: compare the standard exercise posture and the actual exercise posture, and when a difference between the actual exercise posture and the standard exercise posture is greater than a preset threshold, the communication module is controlled to send a prompt message to provide timely feedback and remind the user to perform postural correction, to improve the exercise safety and the exercise efficiency of the user.

In some embodiments, the communication module includes a display, and the processor displays both the standard exercise posture and the actual exercise posture through the display, to enable the user to adjust the actual exercise posture of the exercise in real time based on the display, and to improve the exercise efficiency. In some embodiments, when the difference between the actual exercise posture of the user and the standard exercise posture is greater than a preset threshold, or when a current exercise intensity (e.g., an exercise duration, the actual mechanics information, etc.) of the user exceeds another preset threshold, the processor issues corresponding prompt messages to the user through the display, to remind the user to make postural adjustments or to take a break. In some embodiments, the communication module includes a communication terminal (e.g., a cell phone, a computer), etc., and the processor displays relevant information (e.g., the exercise effect, the prompt message, the actual exercise posture, the standard exercise posture, etc.) at the communication terminal.

The basic concepts have been described above, and it will be apparent to those skilled in the art that the foregoing detailed disclosure serves only as an example and does not constitute a limitation of the present disclosure. Although not explicitly stated here, those skilled in the art may make various modifications, improvements and amendments to the present disclosure. These alterations, improvements, and modifications are intended to be suggested by the present disclosure, and are within the spirit and scope of the exemplary embodiments of the present disclosure.

Moreover, certain terminology has been used to describe embodiments of the present disclosure. As in "an embodiment," "one embodiment," and/or "some embodiments" means a feature, structure, or characteristic associated with at least one embodiment of the present disclosure. Accordingly, it should be emphasized and noted that two or more references to "one embodiment" or "an embodiment" in different positions in the present disclosure do not necessarily refer to the same embodiment. In addition, some features, structures, or characteristics in one or more embodiments of the present disclosure are appropriately combined.

Similarly, it should be appreciated that in the foregoing description of embodiments of the present disclosure, various features are sometimes grouped in a single embodiment, figure, or description thereof for the purpose of streamlining the disclosure and aiding in the understanding of one or more of the various embodiments. However, this disclosure does not mean that the present disclosure object requires more features than the features mentioned in the claims. Rather, the claimed subject matter may lie in less than all features of a single foregoing disclosed embodiment.

Some embodiments use numbers describing quantities of components, and attributes, and it should be understood that such numbers used in the description of embodiments are modified in some examples by the modifiers "about," "approximately," or "substantially." Unless otherwise noted, the terms "about," "approximate," or "substantially" indicate that a ±20% variation in the stated number is allowed. Correspondingly, in some embodiments, the numerical parameters used in the present disclosure and the claims are approximations, the approximations are subject to change depending on the desired characteristics of individual embodiments. In some embodiments, the numerical parameters should consider the specified number of valid digits and utilize a general digit retention method. While the numerical domains and parameters used to confirm the width of their ranges in some embodiments of the present disclosure are approximations, in specific embodiments such values are set to be as precise as possible within a feasible range.

At last, it should be understood that the embodiments described in the present disclosure are merely illustrative of the principles of the embodiments of the present disclosure. Other modifications that may be employed are within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. An exercise device, including a fixing rod, a fixing hook, a connecting member, a first gripping member, and a second gripping member, wherein:

the fixing rod cooperates with the fixing hook to fix the exercise device, the fixing hook is detachably connected to the fixing rod, the fixing rod and the second gripping member are respectively disposed at two ends of the connecting member, the first gripping member is mounted on the connecting member, the first gripping member is selectively switchable between an extended position and an offset position, when the first gripping member is at the extended position, the first gripping member and the fixing hook are respectively located on two sides of a reference plane formed by an axis of the connecting member and an axis of the fixing rod, when the first gripping member is at the offset position, an axis of the first gripping member is located within the reference plane, or the first gripping member and the fixing hook are located on a same side of the reference plane.

2. The exercise device of claim 1, wherein the first gripping member is detachably connected to the connecting member, when the first gripping member is mounted on the connecting member, the first gripping member is at the extended position or at the offset position.

3. The exercise device of claim 1, wherein a fixed end of the first gripping member is rotationally connected to the connecting member by a sleeve disposed outside the connecting member, a free end of the first gripping member is provided with a first gripping portion, at the extended position, the first gripping portion extends towards the second gripping member in an axis direction of the connecting member.

4. The exercise device of claim 3, wherein the connecting member is provided with a first locking portion, the sleeve is provided with a second locking portion, and the first locking portion and the second locking portion are configured to hold the first gripping member at the extended position.

5. The exercise device of claim 4, wherein the first locking portion includes a limiting block disposed at an end of the connecting member proximate to the fixing rod, the second locking portion includes a limiting groove disposed at an end of the sleeve facing the fixing rod, and the limiting groove cooperates with the limiting block to limit a degree of freedom of the sleeve and the first gripping member rotating around the axis of the connecting member relative to the connecting member.

6. The exercise device of claim 4, wherein the connecting member is provided with a slotted hole in the axis direction of the connecting member, the first locking portion includes a positioning member that is arranged within the slotted hole and extends out of the slotted hole to abut against an end portion of the sleeve, an elastic member is provided within the connecting member with one end fixed and the other end connected to the positioning member, the elastic member is configured to apply force to the positioning member to bring the positioning member into contact with the end portion of the sleeve, and the elastic member cooperates with the positioning member to limit a degree of freedom of the sleeve and the first gripping member sliding along an axis direction of the connecting member relative to the connecting member.

7. The exercise device of claim 4, wherein the connecting member includes a limiting region close to the fixing rod and a rotation region away from the fixing rod, the first locking portion includes at least one guiding strip disposed in the limiting region, the second locking portion includes at least one guiding groove disposed on an inner wall of the sleeve, when the sleeve slides along an axis direction of the sleeve to the rotation region, the at least one guiding strip moves out of the guiding groove, thereby switching the first gripping member between the extended position and the offset position, when the sleeve slides in the axis direction of the sleeve to the limiting region, the at least one guiding strip enters the guiding groove to maintain the first gripping member at the extended position or at the offset position.

8. The exercise device of claim 1, wherein the second gripping member is disposed in parallel with the fixing rod, the second gripping member is provided with a second gripping portion and a third gripping portion, and the third gripping portion is closer to an end of the second gripping member than the second gripping portion.

9. The exercise device of claim 8, wherein the end of the second gripping member is further provided with a fourth gripping portion, with the fourth gripping portion extending along an axis direction of the connecting member towards the fixing rod.

10. The exercise device of claim 1, wherein the fixing hook is selectively mounted at different positions on the fixing rod.

11. The exercise device of claim 1, wherein the exercise device further includes a sensor assembly including one or more mechanics sensors, and at least a portion of the one or more mechanics sensors is arranged on the first gripping portion of the first gripping member.

12. The exercise device of claim 1, wherein the fixing hook is installed on the fixing rod through a tube, the fixing hook and the tube are fixedly connected, the tube is sleeved on the fixing rod, and the tube is connected to the fixing rod by a bolt.

13. The exercise device of claim 12, wherein one end of the bolt is exposed out of the tube, and the other end of the bolt is located in the fixing hook.

14. The exercise device of claim 12, wherein the fixing rod is provided with a mounting hole for the bolt to pass through, and the tube includes a first annular sheet and a second annular sheet, the first annular sheet and the second annular sheet are respectively adapted to side surfaces corresponding to the two ends of the mounting hole on the fixing rod, the fixing hook is fixedly connected to the second annular sheet, and the bolt passes through the first annular sheet, the fixing rod, and the second annular sheet sequentially, thereby realizing the connection between the fixing hook and the fixing rod;

a gap is provided between the first annular sheet and the second annular sheet along a user exercise direction, and the gap is used to allow the first annular sheet to deviate when the tube is subjected to force until the first annular sheet abuts against the second annular sheet to bear the force together.

15. The exercise device of claim 11, wherein the second gripping member is provided with a second gripping portion, a third gripping portion, and a fourth gripping portion, each of the second gripping portion, the third gripping portion, and the fourth gripping portion is provided with at least one mechanics sensor.

16. The exercise device of claim 15, wherein the sensor assembly further includes an optical sensor.

17. The exercise device of claim 16, wherein the exercise device further includes a processor configured to:

obtain triggering information and actual mechanics information of the one or more mechanics sensor;

determine exercise standard information based on the triggering information and user information, the exercise standard information including one or more standard exercise postures, standard exercise muscles corresponding to each of the one or more standard exercise postures, and standard mechanics information corresponding to each of the one or more standard exercise postures;

obtain an optical image of a user; and determine an exercise effect of the user based on the optical image, the exercise standard information, and the actual mechanics information.

18. The exercise device of claim 17, wherein the processor is further configured to determine an actual exercise posture of the user based on the optical image;

the exercise effect of the user is determined based on the actual exercise posture, the one or more standard exercise posture, the actual mechanics information, and the standard mechanics information.

19. The exercise device of claim 17, wherein the optical image includes a muscle image, the processor is further configured to correct the exercise effect based on the muscle image.

* * * * *